United States Patent [19]

Steiner

[11] 4,132,248

[45] Jan. 2, 1979

[54] WINDING DEVICE FOR FILLING-YARN BOBBINS

[75] Inventor: Alois Steiner, Rieden, Switzerland

[73] Assignee: Ruti Machinery Works Ltd., Ruti, Switzerland

[21] Appl. No.: 826,267

[22] Filed: Aug. 19, 1977

[30] Foreign Application Priority Data

Aug. 20, 1976 [CH] Switzerland ..... 10602/76

[51] Int. Cl.[2] ..... D03D 47/35

[52] U.S. Cl. ..... 139/436; 139/224 A

[58] Field of Search ..... 139/436, 196.2, 224 R, 139/224 A

[56] References Cited

U.S. PATENT DOCUMENTS

| | | | |
|---|---|---|---|
| 3,862,648 | 1/1975 | Langr et al. | 139/436 |
| 3,976,105 | 8/1976 | Steiner | 139/436 |
| 3,996,974 | 12/1976 | Muller | 139/436 |

FOREIGN PATENT DOCUMENTS

| | | | |
|---|---|---|---|
| 1339777 | 12/1973 | United Kingdom | 139/436 |

*Primary Examiner*—Henry S. Jaudon

*Attorney, Agent, or Firm*—Donald D. Denton

[57] ABSTRACT

Winding device for the filling-yarn bobbins of shuttles of a multi-shed loom having a filling station, which device has a yarn guide rotating on a circular path and conducting a filling yarn, as well as first means for the successive movement of the empty bobbins into the plane of the circle defined by the rotation of the yarn guide.

13 Claims, 7 Drawing Figures

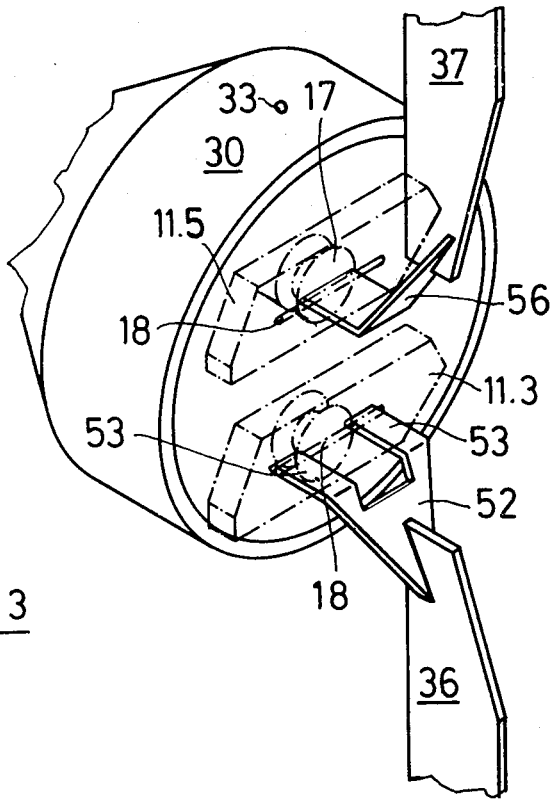
Fig. 3
Fig. 4
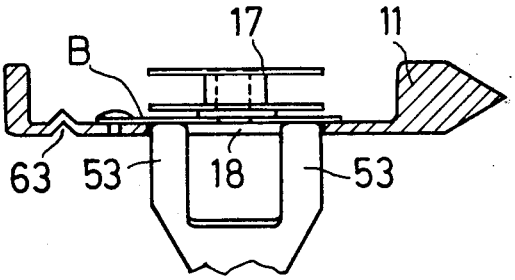

WINDING DEVICE FOR FILLING-YARN BOBBINS

BACKGROUND OF THE INVENTION

The present invention relates to a winding device for the filling-yarn bobbins of shuttles of a multi-shed loom having a filling station, which device has a yarn guide rotating on a circular path and conducting a filling yarn, as well as first means for the successive movement of the empty bobbins into the plane of the circle defined by the rotation of the yarn guide.

It is known to charge filling-yarn bobbins of the shuttles of multiple shed looms with filling yarns during the movement of the shuttles in their return phase. In a first device of this type, a yarn carrier is moved with the same speed as the shuttles parallel to the return conveyor for the shuttles. The yarn supply units, consisting of the filling-yarn feed bobbins and the devices necessary for the drawing off, such as yarn guides, stop motions, etc., are arranged on the yarn carrier in such a manner that opposite each moving shuttle on the parallel conveyance path there is a yarn supply unit which is moved along with it.

It is furthermore known to develop the winding of the bobbins with such a device in the manner that the bobbin in the shuttle is not wound by a rotary movement of the bobbin imparted to it, but rather the yarn is laid onto the nonrotating bobbin by a rotating winder.

These devices have the disadvantage that the expense for the winding of the bobbins is very high. Furthermore, in particular, a large number of yarn supply units and a transport system for their synchronous movement with the shuttles is required. There is also the particular disadvantage that special devices are required in order to hold the ends formed by the cutting of the yarn both in the filling supply unit and in the shuttle after the completion of the winding.

Devices are also known for loading the shuttles of multiple-shed looms in which the supplying of the filling yarn is effected by a single winding place. In such a device the filling yarn is continuously withdrawn from a stationary feed bobbin and wound by a continuously rotating winder onto a stationary winding core which is developed as blade. In this connection, the turns come to lie on the blade, one alongside the other so that orderly winding packages are produced. The shuttles used in this connection have a U-shaped cross-section and are placed from above over the winding package produced on the blade and them, for the introduction of the filling yarn, pushed laterally away from the blade into the shed. This device thus does not serve for the winding of filling-yarn bobbins but for the production of carrier-less yarn winding packages.

Another known device uses a rotatable drum in which the bobbins are arranged on the periphery and are transported by stepwise advance, for the winding, into the region of the rotating winder. Thereupon, they come into a position where the wound bobbins are again turned over to the shuttles. The disadvantage of this device is its intermittent operation; during the stepwise rotation of the drum, the winder must stop and be pulled back in the direction of its axis. This means, on the one hand, a complicated control and movement mechanism and, on the other hand, acts to reduce output.

The closest prior art known to applicant in connection with this application is U.S. Pat. No. 3,263,705.

SUMMARY OF THE INVENTION

The object of the present invention is a winding device for the filling-yarn bobbins of shuttles which, on the one hand, has the smallest possible number of yarn-supply units and, on the other hand, permits continuous operation of the yarn guide.

This purpose is achieved in accordance with the invention by second means for the successive movement of the filled bobbins from the said plane, said first and second means being so controlled that, immediately before the movement of a filled bobbin out of the said plane, an empty bobbin is moved into it, and that both said bobbins are simultaneously in the said plane during a time interval shorter than a single revolution of the yarn guide.

BRIEF DESCRIPTION OF THE DRAWINGS

The invention will be described in further detail below with reference to illustrative embodiments and the drawings, in which:

FIG. 3 is a view showing a detail shown in FIG. 2;

FIG. 4 is a view taken through a shuttle; and

DESCRIPTION OF PREFERRED EMBODIMENTS

Figure 1A:
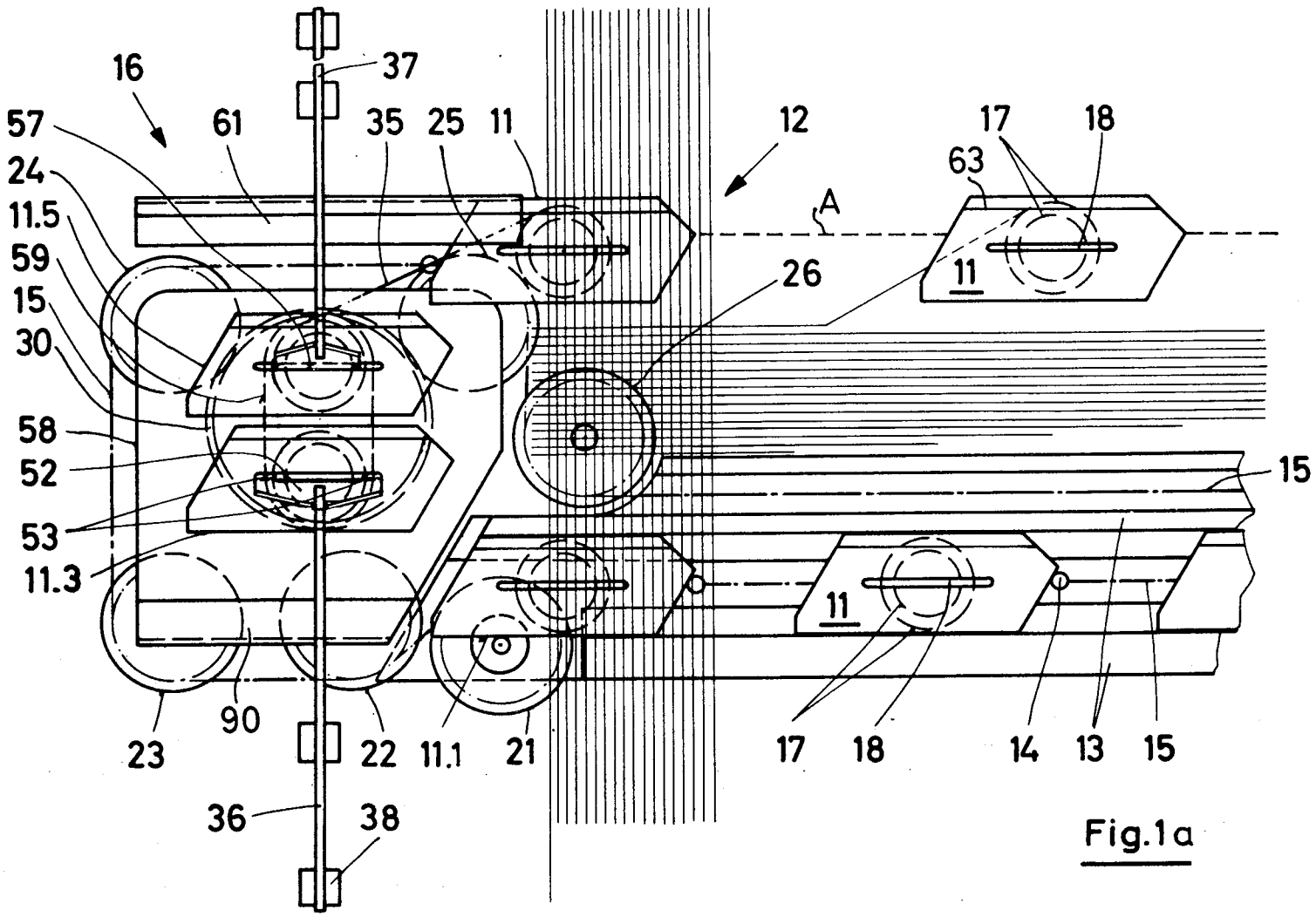
FIGS. 1*a*, 1*b*, 1*c* are views of a filling station for the winding of filling-yarn bobbins in different instantaneous positions respectively, seen from the front.

Referring to FIG. 1*a*, shuttles 11, upon the introduction of the filling yarn, pass from left to right through warp yarns 12 along a horizontal path A, shown in dashed line, and are then returned in a horizontal guide 13. The return is effected by means of conveyor pins 14 which are fastened at equal distances apart to a conveyor or drive chain 15, shown schematically. After the return and before reentrance into the warp yarns 12, the shuttles 11 pass through a filling station 16 in which each shuttle 11 is provided with a length of filling yarn which is dimensioned in accordance with the width of the fabric.

A loom of this type has been described in detail in U.S. Pat. No. 3,513,882 and is incorporated herein by reference. In this loom, the shuttles, upon the introduction of the filling yarn, move from right to left and the filling station is accordingly located on the right-hand side of the loom. Since the direction of transport of the shuttles is however not of essential importance, reference is had to said U.S. Patent for the design and construction of a loom having a winding device in accordance with the invention.

Each shuttle 11 is provided with a yarn bobbin 17. As shown in FIG. 4, this yarn bobbin is fastened to a leaf spring B which is prestressed against the bottom side of the shuttle. By pressure exerted from below, through a slot shaped opening 18 against the leaf spring B, the yarn bobbin 17 can be pushed out of the shuttle body and positioned outside of same, as can be observed from FIG. 2.

The conveyor chain 15 which serves for the backward transportation of the shuttles extends from left to right through the guide 13, around wheels 21 through 26, and from wheel 26 along and above the guide 13 back towards the right as shown in FIG. 1.

The filling station 16 will now be described with reference to FIGS. 1a, 1b, 1c, 2 and 3: The filing station 16 has a rotating bell 30 which is supported in a bearing 31 and can be placed in rotation by means of a belt 32. The longitudinal axis of the bell 30 operatively connected to a drive means is perpendicular to the shuttle path A, while in the embodiment in accordance with the aforementioned U.S. Pat. No. 3,513,882 the longitudinal axis of the bell lies in the direction of the path of the shuttle. At the outermost edge of the bell 30 there is an eye 33. A filling yarn 35 which passes through a borehole 19 in the hollow shaft 34 and from there through a channel F along the outside of the conical part of the bell 30 to the yarn eye 33 and from the latter to a bobbin 17 arranged within the bell 30 is wound, upon rotation of the bell 30, onto the bobbin 17, which is pressed out of a shuttle body.

Furthermore, the filling station 16 comprises a plate 58 along which the shuttles 11 are moved. The plate 58 has a cutout 59.

A lower arm 36 and an upper arm 37 are provided for the actuating of the bobbins 17. The lower arm 36 is swingable around a shaft 38 and borne by the latter. The shaft 38 itself is fastened to one end of a double arm lever 40 which can be swung around a shaft 41 and is provided with a roller 42 at its other free end, the roller travelling on a cam disk 43. A bolt 45 which is displaceable in a slot 44 is fastened to one end of a rod 46, the other end of which bears a roller 47 which rolls on another cam disk 48 and is urged against same by a spring 49. The range of swing of the arm 40 is indicated by lines 51.

The arm 36 bears, at its upper end, an actuating member 52 which has two tines 53. The latter are intended to penetrate through the lateral end regions of the slots 18. A backward and forward movement of the rod 46 results in a backward and forward movement of the actuating member 52 in substantially horizontal direction. A swinging of the double-arm lever 40 around the shaft 41 results in an upward and downward movement of the actuating member 52 and, if the latter has moved into the slot 18 of a shuttle 11, in an upward and downward movement of said shuttle.

The operation of the upper arm 37 is effected in a manner similar to that just described in connection with the lower arm 36, by means of a corresponding double armed lever 40', a rod 46', a displaceable bolt 45', and a slot 44'. An actuating member 56, in contradistinction to the actuating member 52, is provided with a single plate-shaped member 57. Said member is so dimensioned that it can be pushed through the slots 18 of the shuttles 11 in the space between the two tines 53 of the actuating member 52.

Figure 2:
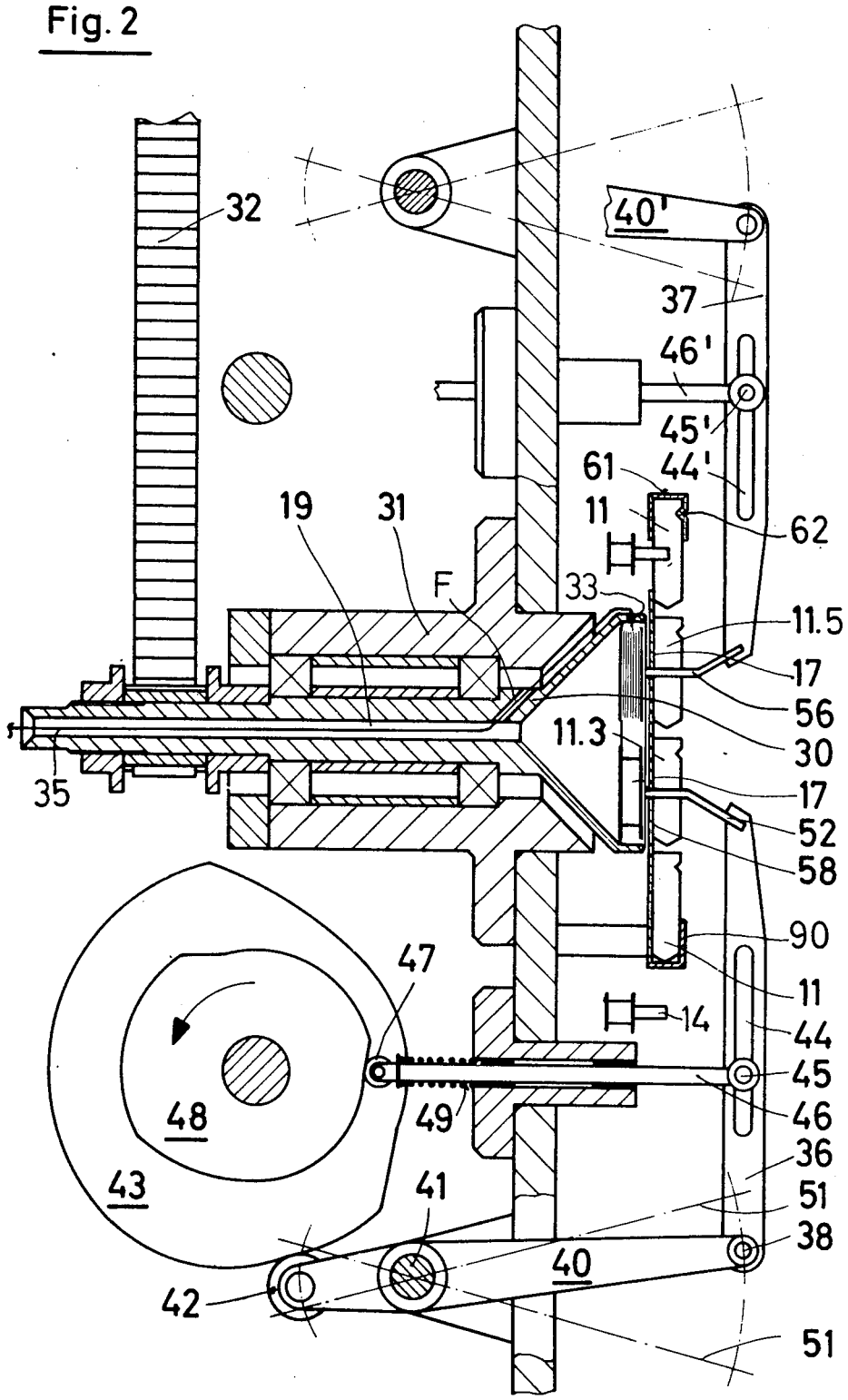
FIG. 2 is a view of the filling station of FIG. 1*a* seen from the side and in section.

The rotating eye 33 describes a circle with the bottins 17 shown in FIG. 2 located in the plane of said circle.

In operation of the loom, the shuttles 11, as already mentioned, are fed through the guide 13 to the filling station 16 by the conveying pins 14 which are fastened to the drive chain 15.

In FIGS. 1a, 1b, 1c, and 2 seven shuttle positions are shown particularly: In the position 11.1 (FIG. 1a) an empty shuttle is located directly before the filling station 16; in the position 11.2 (FIG. 1b) the shuttle has arrived in the filling station 16; in the position 11.3 (FIG. 1a) the winding process has then commenced; in the position 11.4 (FIGS. 1b, 1c) the shuttle which is just wound is located in the center of bell 30; in the position 11.5 (FIG. 1a) the shuttle has just been fully wound; in the position 11.6 (FIG. 1c) the shuttle is held by a holding device 61 and is just set free by the filling station 16 and is ready for being introduced into the warp yarns 12; in the position 11.7 (FIG. 1c) the filled shuttle just completely enters the warp yarns 12.

Referring to the main shaft of the loom, it can be stated that after each rotation of this main shaft by 360° a shuttle 11 enters into the warp yarns 12. In general, it can be stated that at each place where a shuttle 11 is shown in FIGS. 1a, 1b, 1c and 2, the next shuttle will be located after a rotation by 360°.

Figure 1C:
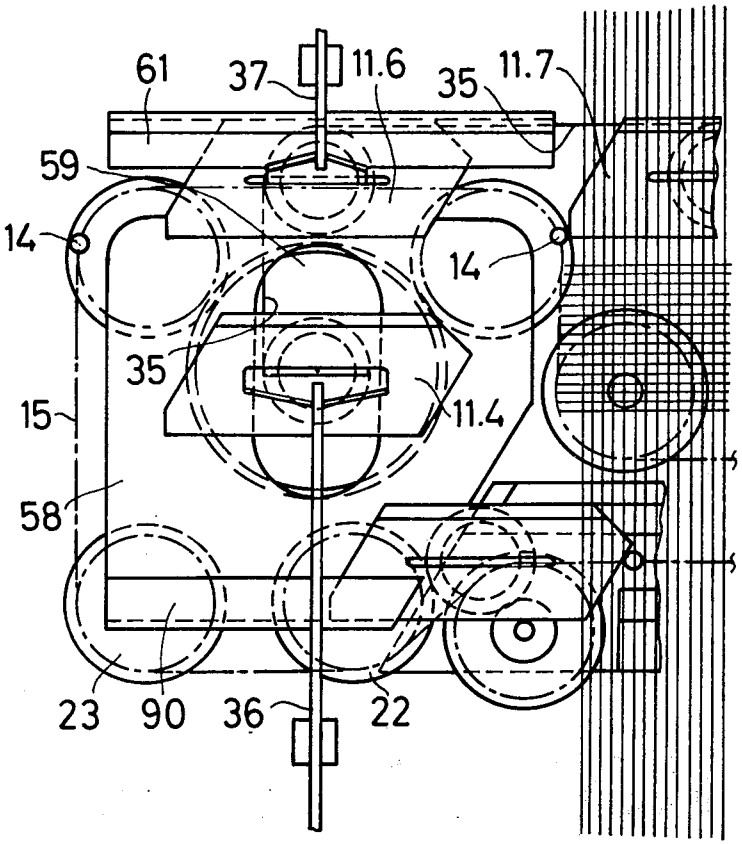
Figure 1B:
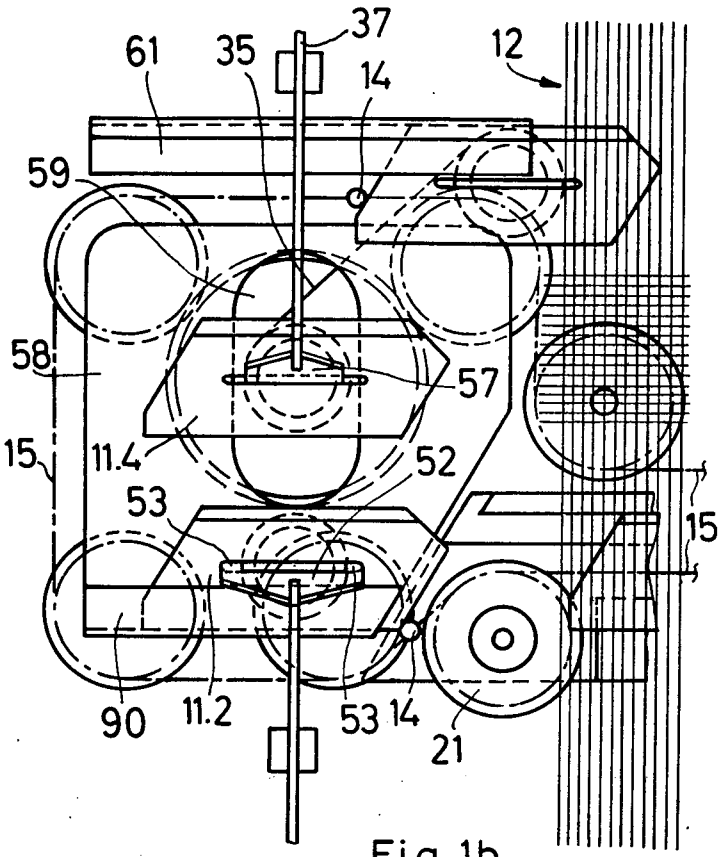

In order to clarify the winding or filling process, attention is directed to the separate shuttle postions: When an empty shuttle 11 is transported to the filling station 16 by chain 15, it reaches the position 11.1 (FIG. 1a) directly in front of the filling station 16. Thereupon by the corresponding pin 14 of chain 15 the shuttle is moved into the lower part of plate 58, which part is formed as guide rail 90 and arrives at the position 11.2 (FIG. 1b). In this position, the pin 14, which has pushed the shuttle, moves downward past the shuttle around the wheel 22. Therefore, the shuttle in the position 11.2 comes to rest.

As a result of the control by the cams 43, 48, the member 52 provided with the tines 53 is, simultaneously, in its lowermost position directly in front of the slot 18 of the shuttle. By movement of the rod 46 or FIG. 2 to the left, the member 52 is moved against the shuttle, the tines 53 extending into the slot 18 of said shuttle. Initially, this penetration is not so deep that the bobbin 17 of the shuttle would be moved with respect to the shuttle body.

Thereupon, as a result of a swinging of the double-armed lever 40 in counterclockwise direction, the arm 36 is moved upward and the shuttle is thus brought into position 11.3 (FIG. 1a). When the shuttle is in this position, further movement of the rod 46 to the left takes place as a result of the shape of the cam 48, as a result of which the arm 36 moves the member 52 further against the bell 30. In this way, the bobbin 17 of the shuttle which is in position 11.3 is pressed by the tines 53 of the member 52 towards the left, as seen in FIG. 2, out of the shuttle body, so that the bobbin 17 is now in the plane of the circle defined by the movement of the eye 33. In this position 11.3, the bobbin 17 is secured against rotation by the pressure exerted on it by the actuating member 52.

At this moment the bobbin 17 of the preceding shuttle present in position 11.5 (FIG. 1a) is within the said surface of rotation. Since the eye 33 rotates continuously, the bobbin 17 of the shuttle in position 11.5 has been wound with the filling yarn 35 which has been guided by the eye 33. Immediately after the moment when the bobbin 17 of the shuttle present in position 11.3 is pushed into the plane of the circle defined by the movement of the eye 33, the bobbin 17 of the shuttle in position 11.5 will now be moved out of the plane of the said circle. The bobbin movements are so synchronized that the bobbin of the following shuttle 11.3 is forced into the plane of the said circle during that time interval within which, as shown in FIG. 2, the eye 33 revolves over the upper half of its circular path, i.e. on the side of the bobbin 17 of the shuttle in position 11.5. The bobbin of the preceding shuttle 11.5 is correspondingly moved out of the plane of the circle while the eye 33 rotates over the lower half of its circular path, i.e. on the side of the bobbin 17 of the shuttle in position 11.3.

It may be pointed out with respect to the process which has just been described that the movement of the bobbins 17 of the shuttles in positions 11.3 and 11.5 into the plane of the circle described by the rotation of the eye 33 and out of said plane must not take place suddenly but must proceed in a relatively continuous manner. It should be seen to it that no length of yarn is produced which winds around both bobbins. On the other hand, the case in which the eye 33 makes a revolution without yarn 35 being wound on one of the bobbins is scarely disadvantageous and in any event does not have any serious consequences.

After the bobbin 17 of the shuttle in position 11.5 has been moved again by the leaf spring B acting on the bobbin (FIG. 4) into the shuttle body, since the rod 46' has been pushed to the right by the cam disk (not shown) associated with it, the double-arm lever 40' is imparted a movement in counter-clockwise direction, as a result of which the shuttle is lifted out of position 11.5 and is grasped by a holding device 61. After the shuttle had been turned over to the holding device 61 and has arrived at the position 11.6 (FIG. 1*c*), the rod 46' is imparted its maximum movement towards the right, as a result of which the actuating member 56 moves out of the slot 18 of the shuttle. Thereupon the actuating member 56 can move downward and take over the following shuttle. The shuttle is moved out of the filling station 16 and along the holding device 61 transverse to the warp yarns 12 by the chain 15 provided with the pins 14 and enters in the position 11.7 (FIG. 1*c*) into the warp yarns 12 completely. The holding device 61 is formed by a resilient, U-shaped rail which is provided at its one inner side with a rib 62. This rib 62 engages with a corresponding depression 63 of the shuttle 11 (FIG. 4). Therefore, the shuttles are held by the holding device 61.

While the shuttle shown in position 11.5 is moved towards the holding device 61 to the position 11.6, the shuttle shown in position 11.3 has been moved into the position 11.4 (FIG. 1*c*) in the center of the circle described by the eye 33 and has been continuously wound.

It cannot be moved further upward by the actuating member 52. However, in this position, the actuating member 56 is moved into the slot 18 of the shuttle present in the said plane, whereupon the actuating member 52 moves out of the slot. The winding process continues without interruption, and the shuttle to be wound is thereupon moved into position 11.5 from its position 11.4 (FIG. 1*b*) in the center of the circle defined by the rotating eye 33.

In the meantime, the actuating member 52 moves into its lowermost position in which it extends into the slot 18 of the shuttle newly introduced into the filling station 16 and being located in the position 11.2 (FIG. 1*b*) without first of all forcing the bobbin thereof out of the shuttle body, and moves this shuttle into position 11.3 (FIG. 1*a*).

It is thus clear that the actuating member 52 moves between the position of the slot 18 of a shuttle present at a given place outside the circle defined by the rotating eye 33 and the center of this circle. The actuating member 56 similarly moves between the center of said circle and the position of the slot 18 of a shuttle present at another place outisde the circle.

It is possible during the winding process to have the bobbin 17 which is being wound carry out a backward-and-forward movement in the direction of the bobbin axis, so that a surface winding is produced on the bobbin. Such a backward-and-forward movement can be produced for instance by a corresponding undulated shape of the cam 48.

It is clear that upon the passage of a shuttle from the movement member 52 to the movement member 56, both end parts 53 and 57 are for a short time within the slot 18 of the shuttle. For this reason, the part 52 is developed as fork with the tines 53, and the part 57 forms an elongated individual piece which comes between the two tines 53 of the fork 52.

It is clear from FIG. 1*a* that the chain 15 having the pins 14 travels around the wheels 24, 25, and 26 and from wheel 26 parallel to the guide 13. At the right end (not shown) of the latter, the chain 15 enters the guide 13. The shuttle which is held by the holding device 61 is carried along by a pin 14 of the chain 15 and pushed into the warp yarns 12, as shown in FIGS. 1*a* through 1*c*. The inserted shuttle is thereupon moved further by the shuttle drive which is provided for the moving of the shuttles through the shed.

Upon the movement of the shuttle out of position 11.5 into the position 11.6, the distance of said shuttle from the following shuttle becomes larger. The larger length of yarn between the shuttles which thus becomes necessary is taken from the bobbin 17 of the preceding shuttle, the bobbin 17 therefore being turned automatically backward by the filling yarn. The distance between the two shuttles is again increased when the preceding shuttle is pushed by a pin 14 of the chain 15 into the warp yarns 12, as is true of the shuttle in position 11.7. During this process also, the required greater length of yarn is obtained by automatic backward winding of the bobbin 17 of the front shuttle. After a shuttle has entered completely into the warp yarns 12, the filling yarn 35 extending from the shuttle is woven-in on the left-hand end of the fabric and thereupon cut at the edge of the fabric. It is clear that upon the backward winding which has just been mentioned the resultant length of yarn extends from the following shuttle, in this case from the shuttle in position 11.6, to the place of cut at the edge of the fabric. Upon renewed backward winding of the bobbin of the following shuttle, this length of yarn is again wound on the bobbin thereof in the form of a few turns and, in particular, introduced into the inside of said shuttle so that this length of yarn does not in any way give rise to disturbances.

It is necessary that the passage of the pins 14 in the region above the winding device 16 take place synchronously with the emergence of the shuttle 11 from the winding device 16. A simple arrangement with which any desired adjustment in this connection is obtained consists in the fact that the wheels 23, 24 can be fastened in different selectable positions, e.g. in horizontal direction, parallel to the plane of the drawing. The length of the chain 15 must of course be selected in accordance with the different horizontal positions of the wheels. However, instead of this, the course of the chain 15 can also be made adjustable at the right-hand end (not shown).

Figure 5:
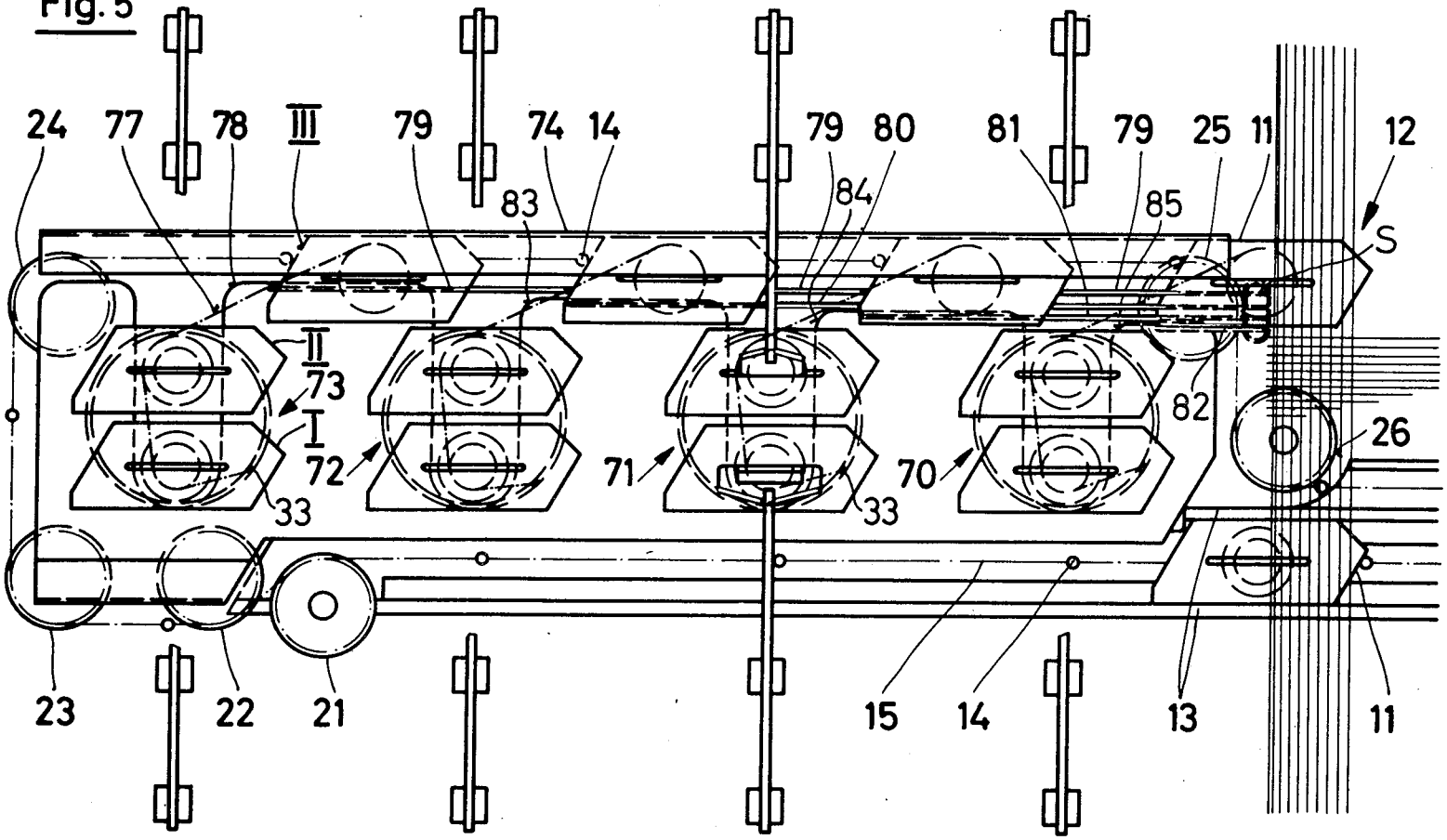
FIG. 5 is a view showing an embodiment having four filling stations.

In the embodiment shown in FIG. 5, four filling stations 70, 71, 72, and 73 are provided. The chain 15, by means of the pins 14, moves the shuttles 11 in the guide 13 from right to left. After it has brought the shuttles 11 to the inlets of the filling stations 70 through 73, it is conducted over the guide wheels 21, 22, 23, and 24, and thereupon pushes the shuttles, provided with new filling yarn windings, above the filling stations 70 through 73 towards the right into the warp yarns 12 by means of the pins 14. Thereupon the chain 15 is conducted over the guide wheels 25 and 26 and passes above the guide 13 towards the right to the right-hand end of the guide 13.

Each of the filling stations 70 through 73 corresponds essentially in its construction to the filling station 16 shown in FIGS. 1*a*, 1*b*, 1*c*, 2 and 3.

In the case also of the arrangement shown in FIG. 5, similar to the case of the filling station 16 FIGS. 1*a* through 1*c* upon each rotation of the main shaft of the loom by 360° a shuttle 11 is introduced into the warp yarns 12. Similarly, during a time interval corresponding to the 360° each pin 14 moves into the position of the pin preceding it.

In the operation phase shown in FIG. 5, there are two shuttles in each filling station 70 through 73, the winding process having just been completed in the case of each preceding shuttle 11 and having just commenced in the case of each following shuttle I. Further shuttles 11 are now moved in the guide 13 to below the filling stations 70 through 73 on the one hand while, on the other hand, the shuttles present in the holding device 74 move towards the right towards the warp yarns 12. As soon as the last shuttle leaves the holding device 74, the four preceding shuttles II are simultaneously moved into the holding device 74, so that the introduction of shuttles into the warp yarns 12 is not interrupted and proceeds at regular intervals. In the meantime, a new shuttle has been brought below each filling station 70 through 73 and the four shuttles in position I have been moved into the position of the shuttles II shown in the drawing, so that now these four newly arrived shuttles can be brought simultaneously into the positions of the shuttles I shown in the drawing.

It is clear that the winding process at each of the filling stations 70 through 73 extends over a period of time which is approximately equal to four times the time interval of 360°. Thus much more time is available for a winding process than in the case of the embodiment shown in FIGS. 1*a*, 1*b*, 1*c*, 2 and 3.

In the same way as in the case of the filling station 16 FIGS. 1*a* through 1*c*, a yarn is both unwound from and rewound on the shuttle bobbin 17 during the transportation of the shuttles 11 towards the warp yarns 12. In order that the lengths of yarns between the bobbin 17 do not become entangled, a special channel is provided for each length of yarn:

When the shuttle 11 moves from the filling station 73 into the position III, the winding yarn 77 is placed behind the guide wall 78 corresponding to the wall 58 of the filling station 16 (FIG. 2), whereupon it comes to lie on a horizontally arranged plate 79 forming a guide, said plate forming a channel together with the guide wall 78. At the same time, the length of filling yarn placed by the preceding shuttle 11 on the plate 79 is wound up again by said shuttle, i.e. pulled away from said guide. After the entrance of the shuttle into the warp yarns 12, the filling yarn 77 is beaten-up and woven into place. Thereupon, it is cut and held by scissors. The movement of the scissors is controlled in such a manner that they keep the held yarn in relatively stretched position on the plate 79. At the end thereof facing the warp yarns 12, there is a suction nozzle S by which the yarn end fed by the scissors is drawn-in as soon as the length of filling yarn 77 is released from the holding part of the scissors. In corresponding manner, the filling stations 70, 71 and 72 are also provided with plates 82, 81 and 80 which, together with the corresponding guide walls 85, 84 and 83, form channels. The individual channels lie one above the other, and each of the guide walls 83, 84 and 85 is of such a height that there is a space left between its upper edge and the plate 81, 80, and 79, respectively, which participate in forming the next higher channel. In this way, each length of filling yarn is laid in the corresponding associated channel.

Although the invention is described in detail for the purpose of illustration, it is to be understood that such detail is solely for the purpose and that variations can be made therein by those skilled in the art without departing from the spirit and scope of the invention except as it may be limited by the claims.

What is claimed is:

1. A winding device for the filling-yarn bobbins of shuttles of a multi-shed loom, having a filling station which has a yarn guide which rotates on a circular path and conducts a filling yarn, and a first means for the successive moving of the empty bobbins into the plane of the circle defined by the rotation of the yarn guide, characterized by a second means for the successive moving of filled bobbins out of the said plane, means controlling said first and second means as that immediately before a filled bobbin is moved out of the said plane an empty bobbin is moved into it, and both said bobbins are simultaneously in said plane during a time interval shorter than a single revolution of the yarn guide.

2. The winding device according to claim 1 having an endless chain guided over guide wheels for the feeding of the shuttles to and the removal from the filling station, characterized by the fact that at least one of the guide wheels can be fastened alternately at different positions, said positions lying in a plane parallel to the plane defined by the path of movement A of the shuttles.

3. The winding device according to claim 1 in which each of said first and second means comprises an actuating member which is movable substantially perpendicularly to said plane, said actuating members acting through an opening in a wall of the shuttles on their bobbins and moving the bobbins out of the shuttles into the said plane, and vice versa.

4. The winding device according to claim 3 in which the bobbin which has been moved into the said plane is secured against rotation by the associated actuating member.

5. The winding device according to claim 3 in which the yarn guide is carried by a bell-shaped rotation member which can be driven in the direction of rotation, and the path of transportation of the shuttles and of the bobbins within the region of the rotation member extends along a diameter of the rotating member.

6. The winding device according to claim 5 in which the axis of rotation of the bell-shaped rotating member is directed perpendicular to the path of transport of the shuttles through the warp yarns.

7. The winding device according to claim 6 in which the said plane lies in the inside of the bell-shaped rotation member and the yarn guide is formed by an eye in its wall, and the inside diameter of the rotation member is greater at the place of said plane than twice the outside diameter of a bobbin.

8. The winding device according to claim 7 in which the bobbins are moved into one half of said plane by the movement of the first means perpendicular to said plane and out of the other half of the plane by the vertical movement of the second means, and the bobbins are moved by the first means from the one half of the plane into the center thereof and by the second means from the center into the other half of the plane.

9. The winding device according to claim 8 in which each of the actuating members is carried by a first arm swingable about a shaft to produce the movement directed substantially perpendicular to said plane, and the shaft in its turn is carried by a second swingable arm for producing the movements in the said plane and parallel to it.

10. The winding device according to claim 9 in which the first and second arms are guided by separate cam surfaces of two eccentric disks and moved by same, and a rod, one end of which is fastened to the first arm, is guided at its other end on one of the cam surfaces and the second arm forms the one arm of a double-armed lever whose other arm is guided on the other one of the cam surfaces.

11. The winding device according to claim 8 in which each filling yarn bobbin rests with initial stress against the side wall of its shuttle, said side wall being provided with said opening.

12. The winding device according to claim 11 in which the opening is developed as an elongated slot, the one actuating member comprising a fork-shaped element having two tines, and the other actuating member comprising a plate-shaped element whose width is less than the distance between the tines.

13. The winding device according to claim 5 in which directly in front of the rotation member and parallel to the said plane, there is arranged a guide wall, the shuttles being guided along the side of said wall facing away from said plane and said guide wall being provided with a cut-out in the region in which the bobbins extend into the rotation member.

* * * * *